US008371082B2

(12) United States Patent
Hobbs

(10) Patent No.: US 8,371,082 B2
(45) Date of Patent: Feb. 12, 2013

(54) WALL FORMING SYSTEM HAVING A FURRING STRIP ASSEMBLY SECURED TO A PAIR OF PANELS TO HOLD THE PANELS IN SPACED RELATION

(76) Inventor: Andrew Hobbs, Urbandale, IA (US)

( * ) Notice: Subject to any disclaimer, the term of this patent is extended or adjusted under 35 U.S.C. 154(b) by 908 days.

(21) Appl. No.: 12/065,348

(22) PCT Filed: Aug. 31, 2006

(86) PCT No.: PCT/US2006/034202

§ 371 (c)(1),
(2), (4) Date: Feb. 29, 2008

(87) PCT Pub. No.: WO2007/028006

PCT Pub. Date: Mar. 8, 2007

(65) Prior Publication Data

US 2008/0237441 A1 Oct. 2, 2008

Related U.S. Application Data

(60) Provisional application No. 60/767,207, filed on Mar. 10, 2006, provisional application No. 60/596,093, filed on Aug. 31, 2005.

(51) Int. Cl.
*E04B 2/86* (2006.01)
*E04B 2/10* (2006.01)

(52) U.S. Cl. ..... 52/453; 52/426; 52/439

(58) Field of Classification Search ..... 52/426, 52/427, 434, 435, 442, 439, 437, 438; 249/35, 249/38

See application file for complete search history.

(56) References Cited

U.S. PATENT DOCUMENTS

| | | | | | |
|---|---|---|---|---|---|
| 1,420,478 | A * | 6/1922 | Forbush | 52/426 |
| 2,085,472 | A | 6/1937 | Roush | |
| 2,316,668 | A * | 4/1943 | Bronner | 52/434 |
| 3,609,933 | A * | 10/1971 | Jahn et al. | 52/481.2 |
| 3,835,608 | A * | 9/1974 | Johnson | 52/426 |
| 4,443,991 | A * | 4/1984 | Mieyal | 52/481.2 |
| 5,092,100 | A * | 3/1992 | Lambert et al. | 52/481.1 |
| 5,596,855 | A * | 1/1997 | Batch | 52/426 |
| 5,625,989 | A * | 5/1997 | Brubaker et al. | 52/426 |
| 5,692,356 | A * | 12/1997 | Baxter | 52/426 |
| 5,749,192 | A * | 5/1998 | Menchetti | 52/481.1 |
| 5,809,728 | A * | 9/1998 | Tremelling | 52/426 |
| 5,852,907 | A * | 12/1998 | Tobin et al. | 52/426 |
| 6,250,033 | B1 * | 6/2001 | Zelinsky | 52/275 |
| 6,698,710 | B1 * | 3/2004 | VanderWerf | 249/216 |
| 6,922,962 | B2 * | 8/2005 | Schmidt | 52/426 |
| 6,990,774 | B2 * | 1/2006 | Clapp | 52/426 |

* cited by examiner

*Primary Examiner* — Michael Safavi

(74) *Attorney, Agent, or Firm* — Zarley Law Firm, P.L.C.

(57) ABSTRACT

A wall forming system that uses a pair of panels in combination with a furring strip assembly and retainer The pair of panels are placed in spaced relation using the combination of the furring strip assembly and the retainer wherein the furring strip assembly holds the exterior of the panels while the retainer is disposed between the panels to hold them at a predetermined distance. By holding the panels at a predetermined distance concrete is poured within the cavity formed between the panels to create a wall.

13 Claims, 6 Drawing Sheets

WALL FORMING SYSTEM HAVING A FURRING STRIP ASSEMBLY SECURED TO A PAIR OF PANELS TO HOLD THE PANELS IN SPACED RELATION

CROSS REFERENCE TO A RELATED APPLICATION

This application is based upon Applicants' Provisional Applications Ser. Nos. 60/596,093 filed Aug. 31, 2005 and 60/767,207 filed Mar. 10, 2006.

BACKGROUND OF THE INVENTION

This invention is directed toward a wall forming system and more particularly a wall forming system that requires less concrete.

Wall forming systems are well known in the art. Generally, a wall forming system has a pair of vertical panels that are held in spaced relation by a tie rail or furring strip assemblies. The space between these panels creates a generally uniform cavity where concrete is formed. The problem with such wall systems is that they require more concrete due to the cavity formed which adds to expense, and the amount of insulation provided by the panels is likewise limited. Excess concrete additionally increases fluid pressures that create blow outs, bowing and snaking of walls and ultimately contribute to poor quality of finished product of typical ICF systems. Therefore, a need exists in the art for an improved wall system.

An object of this invention is to provide a wall system that requires less concrete.

Another object of the present invention is to provide a wall system that provides greater insulation.

A still further object of this invention is to provide a wall system that is easier to assemble.

BRIEF SUMMARY OF THE INVENTION

A wall forming system having a pair of panels that are positioned in spaced relation from one another to form a cavity having a web section and a column section. There is at least one furring strip assembly secured to the pair of panels to hold the panels in spaced relation wherein the furring strip assemblies have retaining flanges with a web section that spans between the flanges. A retainer is then disposed within the furring strip assembly and within the cavity contacting the panels to hold the panels in place.

DETAILED DESCRIPTION OF THE PREFERRED EMBODIMENT

Figure 1:
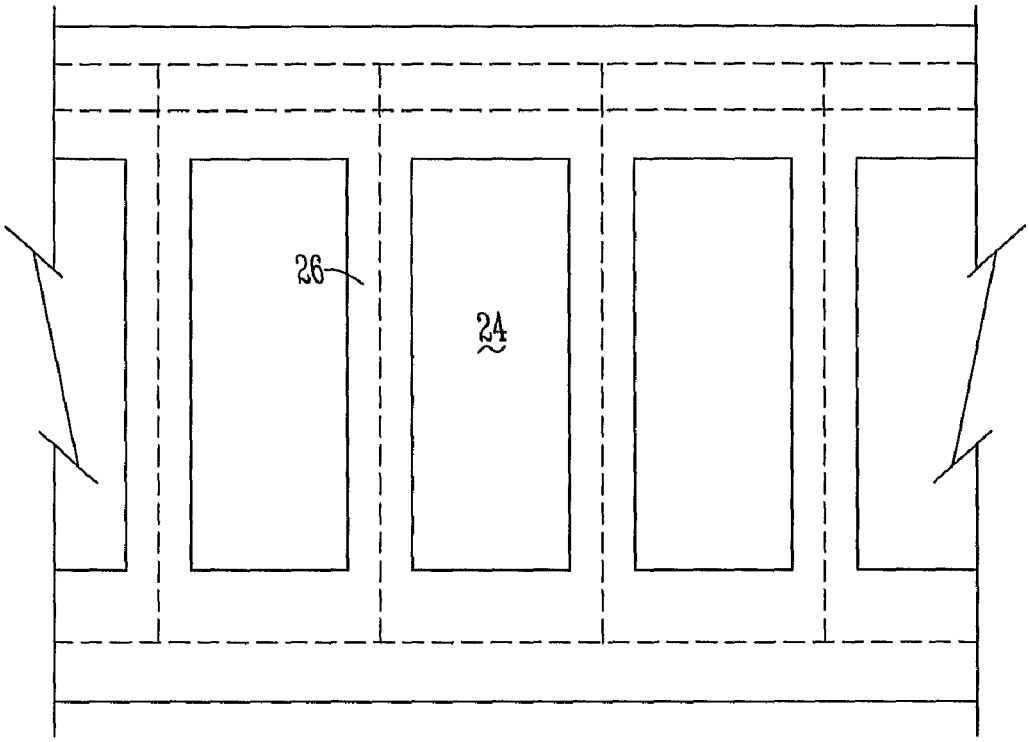
FIG. 1 is an elevation view of a concrete structure formed within the wall forming system.
Figure 2:
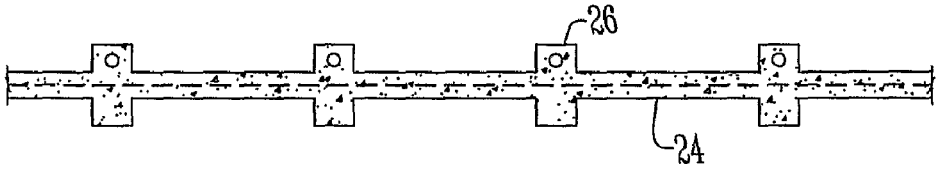
FIG. 2 is a plan top view of a concrete structure formed within a wall forming system.
Figure 3:
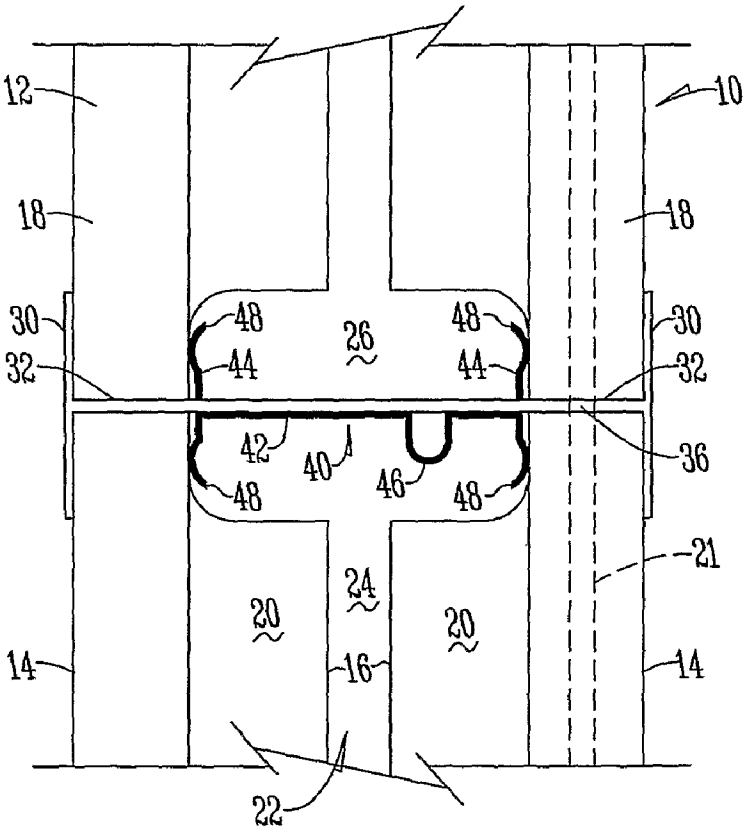
FIG. 3 is a top plan view of a wall forming system.

Referring to the FIGS. 1-3, the wall forming system 10 includes a pair of panels 12 having an outer surface 14 and an inner surface 16. The panels have an outer section 18 that extends longitudinally the length of the outer surface 14 and an inner section 20 that extends inwardly from and has a length less than the outer section 18. A channel or conduit 21 may be cut through the outer section 18 for receiving electrical wires and the like. Specifically the conduit 21 is pre-cut for ease of installation of the electrical wires or preferably cut on-sight. The panels 12 are made of a material having a relatively high insulating value.

When assembled, two panels 12 are positioned in spaced relation where inner surfaces 16 face one another and form a cavity 22 having a web section 24 and a column section 26. The cavity 22 receives poured concrete or other hardenable materials. When hardened, the hardenable materials form a wall structure.

Figure 4:
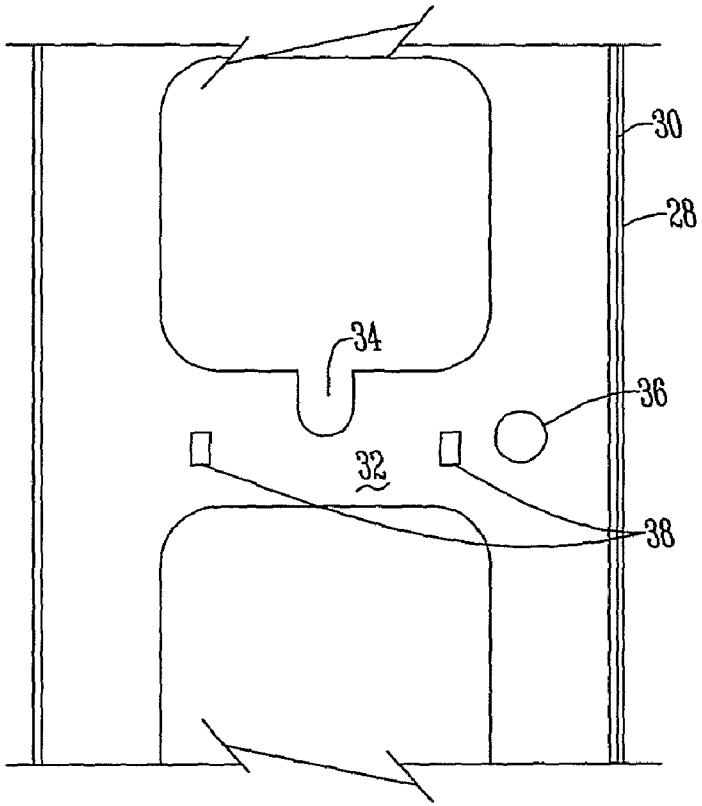
FIG. 4 is a plan side view of a furring assembly.
Figure 6:
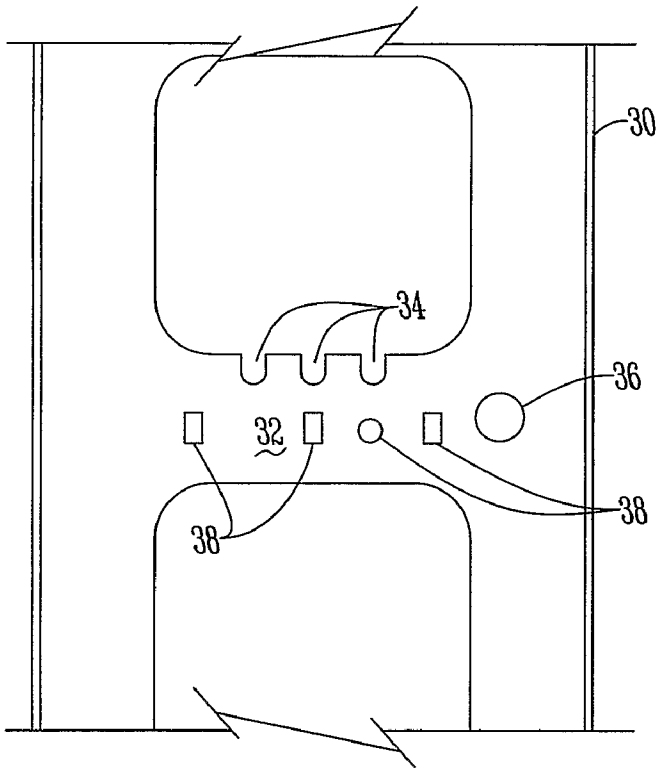
FIG. 6 is a side plan view of a furring assembly.

The panels 12 are held in position relative to one another, and relative to adjacent pairs of panels 12 by a furring assembly 28. While the furring strip assembly 28 may have any shape, as shown in FIGS. 4 and 6, preferred is a strip 28 having retaining flanges 30 and one or more webs or connectors 32 that span the distance between the flanges 30. The webs 32 may include one or more slots 34 to hold conventional reinforcing bars (not shown). Such reinforcing bars are provided to strengthen and increase the durability of the poured, cured, and hardened final wall structure.

Cut out of the furring assembly 28 in alignment with conduit 21 is one or more openings 36. The openings allow wires to extend from the conduit 21 of one panel 12 to the conduit 21 of an adjacent panel 12 through the opening 36.

Figure 8:
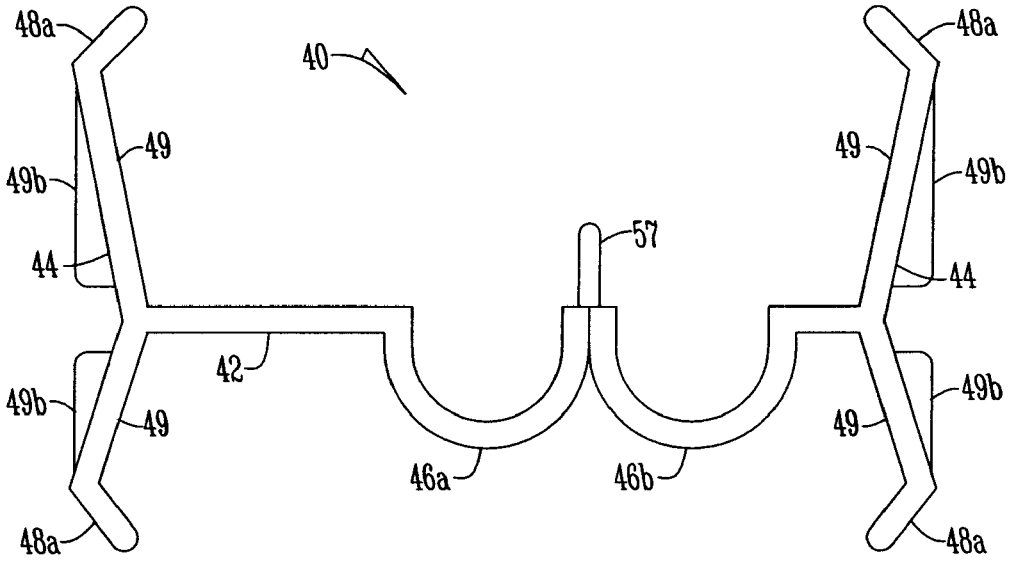
FIG. 8 is a side plan view of a retainer for a wall forming system.

Disposed within the connector 32 of the furring strip assembly 28 are a plurality of retaining slots 38. One of the retaining slots may be offset in relation to the other slots so that the retainer 40 may be installed one way and is not reversible. The retaining slots 38 can be of any shape. A retainer 40 is inserted through slots 38 to hold panels 12 in place. Preferably a retainer is positioned at the top and bottom of the furring strip assembly. The retainer can be of many shapes (e.g. FIGS. 3, 8, etc.). In one embodiment (FIG. 3) the retainer 40 has a longitudinal section 42 with supporting flanges 44 connected to the ends. The longitudinal section 42 has at least one vertical rebar holder 46 and the flanges 44 have generally arcuate ends 48 that engage inner surface 26. The generally arcuate ends 48 allow for easy insertion of panels 12 and provide a spring type action to hold the panels in place.

In another embodiment (FIG. 8) the retainer 40 has a longitudinal section 42 with supporting flanges 44 and having first and second vertical rebar holders **46*a* and 46*b*. The flanges 44 have flange sections 49 that extend outwardly from the longitudinal section 42 to ends 48*a* that extend in an opposite direction to the flange sections 49. The flanges 44 are flexible and fit through retaining slots 38. Further, the flange sections 49 have angled longitudinal prongs 49*b* that hold the panels 12** in place.

Figure 9:
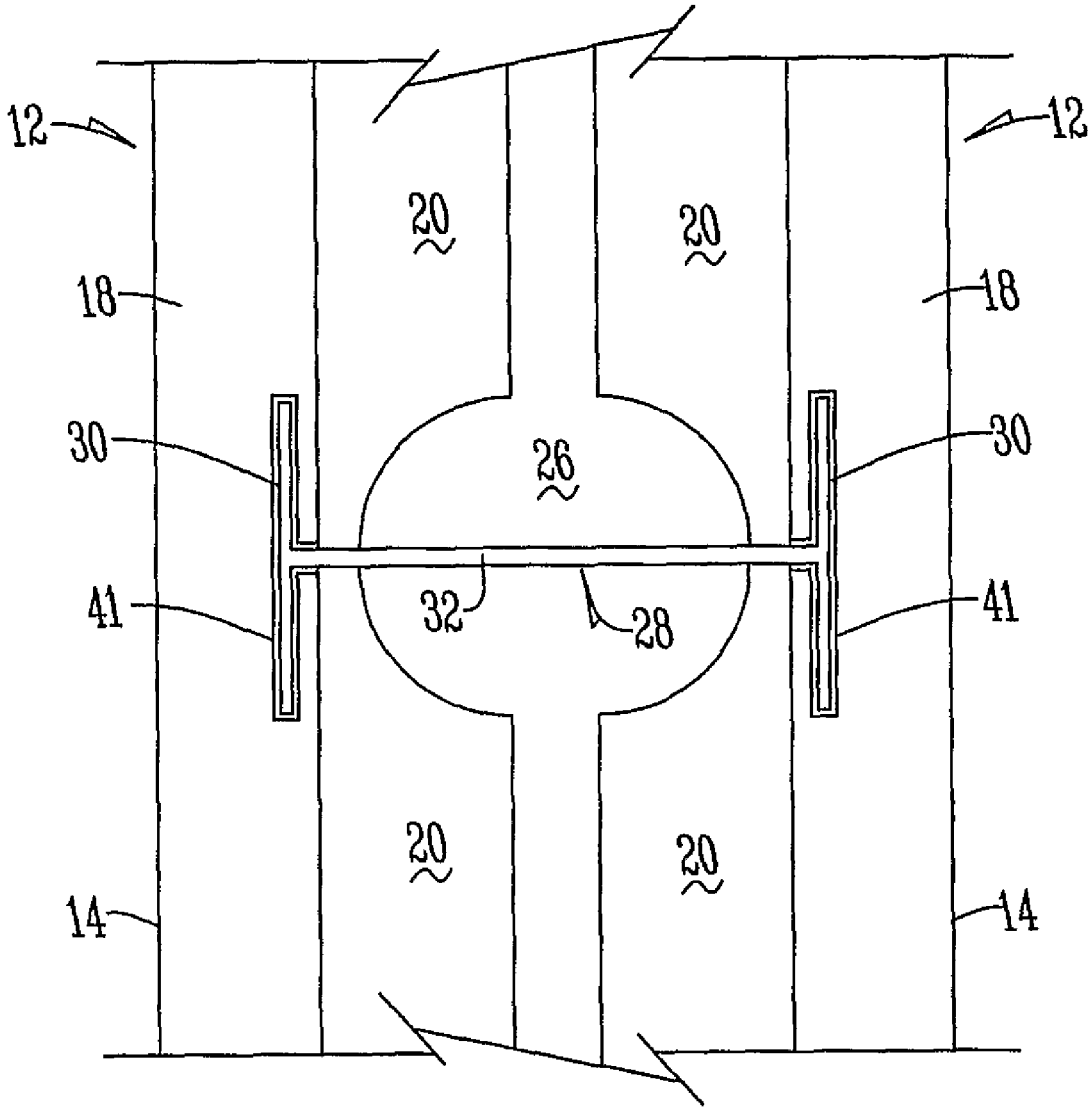
FIG. 9 is a top plan view of a wall forming system.

Alternatively, the furring strip assembly 28 is received in grooves 41 cut within the panels 14 as shown by example in FIG. 9 so that the outer surface 18 of panel 14 more readily receives stucco or EISS material.

To assemble, the ends 48, **48*a* of flanges 44 of the retainer 40 are inserted through retaining slots 38 and frictionally held in place. The outer section 18 of the panel is then inserted between flange 30 and 44. The arcuate shape facilitates insertion of the panel 12. Vertical and horizontal rebar (not shown) are added as needed to holders 46, 46*a*, 46*b* and 34 respectively. Concrete is then poured into cavity 22** and allowed to harden.

Figure 5:
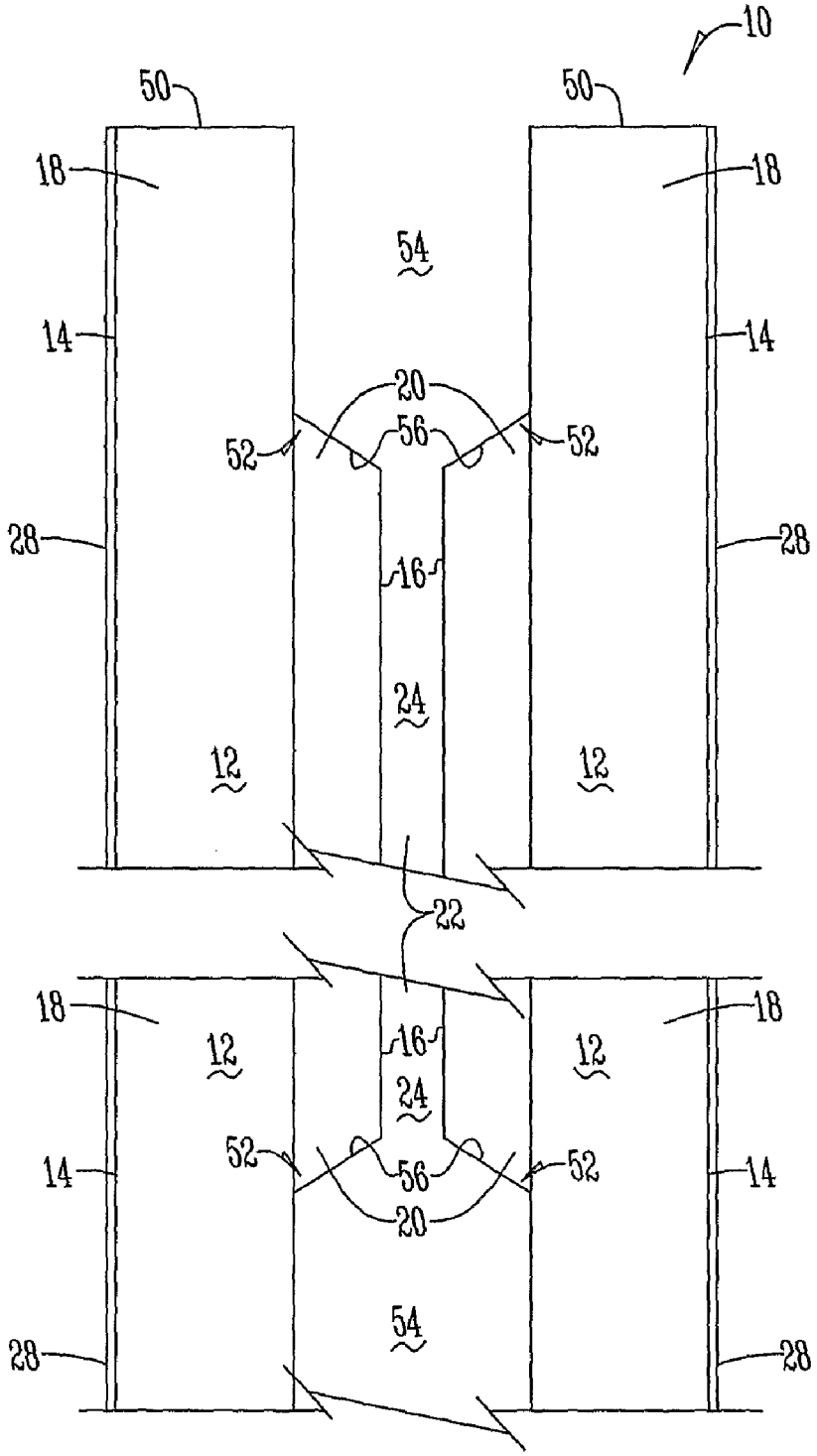
FIG. 5 is a plan side view of panels of a wall forming system.

In an alternative embodiment, as shown in FIG. 5, the inner section 20 of the panel 12 is spaced from the top edge 50 of the panel 12 to form a shelf 52 that defines a beam 54. Preferably, the shelf has a tapered or angled surface 56 that extends from the panel 12 toward the cavity 22. The tapered surface 56 facilitates flow of a hardening material from the beam 54 to the web section 24.

Also, the furring strip assembly 28, alternatively, has a plurality of slots 34 for receiving reinforcement bars. By having a plurality of slots 34, flexibility is provided to place horizontal reinforcement bars such that they do not intersect with vertical reinforcement bars. This is particularly a problem with above grade construction where vertical rebar is typically centered.

To further assist with this problem, a retainer 40 having multiple vertical rebar holders 46(A & B) is used. Such a retainer 40 allows for use below grade (off-set rebar holder 46B) which provides a gain of approximately 50% in strength, and above grade (centered rebar holder 46A). To better secure the retainer to the furring strip assembly 28 a locking device 57 such as a spring clip extends transversely from the longitudinal section 42, preferably from the point where the vertical rebar holders 46A and B intersect. The spring clip (not shown) is inserted through a retaining slot 38 and expands outwardly to engage the connector 32 holding the retainer in place. In another embodiment, the locking device 57 (FIG. 8) is a pin that is offset to insure that the pin 57 is installed in the correct position. Accordingly, rebar will not be installed in the wrong location in a below grade application where rebar is installed on the opposite sides of the lateral forces (opposite backfill). The furring strip assembly 28 and retainers 40 are used with conventional straight panels or with panels 12 having an inner section 20 that forms a web section 24 and/or a beam 54.

Figure 7:
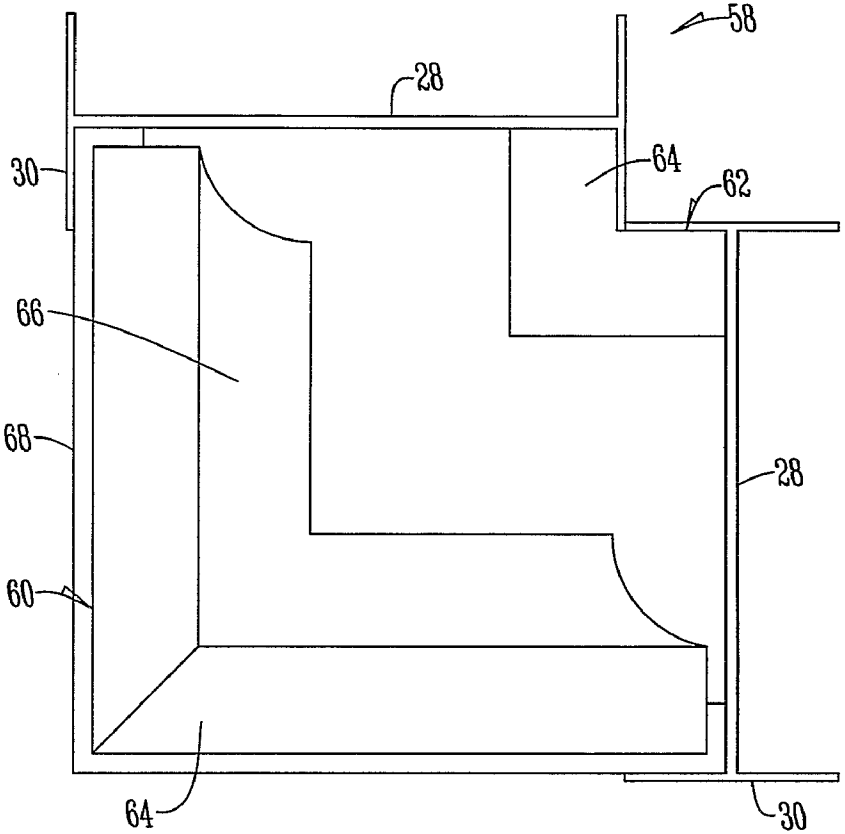
FIG. 7 is a top plan view of a corner of a wall forming system.

The wall forming system 10 also has a corner section 58 shown in FIG. 7. The corner section has an outer panel 60 and an inner panel 62. The outer panel 60 and inner panel 62 both have an outer section 64 and an inner section 66, with the inner sections 66 facing one another. In one embodiment, the inner section 66 is spaced from the top edge 50 of the panels 60 and 62 to form a shelf 52 that defines an area for a beam 54. The shelf 52 may have an angled surface 56 to facilitate flow of hardening material.

The inner and outer panels 60 and 62 are held in place by furring strip assemblies 28 that are transverse to one another. In most situations the furring strip assemblies 28 are at a 45° angle in relation to one another, but, depending upon the construction specifications, other angles are contemplated.

Positioned between the outer panel 60 and the furring strip assembly 28, is a support member 68. The support member 68 surrounds the outer surface 16 of outer panel 60 to provide support, as well as a surface upon which materials, including exterior finish materials such as aluminum siding or the like, may be mounted. The support member 68 is made of any rigid material such as polycarbonate, wood, or metal, and may be formed as a single piece or in multiple pieces.

The corner section may be pre-made, or modified to be bent to any angle on job sites using templates for particular specifications which is helpful when the corner angle is not standard.

Thus, a system 10 is provided that reduces the amount of needed concrete, increases the amount of insulation provided and is easy to assemble. This reduced concrete causes a decrease in fluid pressures thus minimizing blow outs, bowing and snaking of walls. Thus, the system creates a high quality concrete wall that is straighter, taller, and more easily made with a user friendly system than previous concrete walls. Therefore, at the very least, all of the stated objectives have been met.

It will be appreciated by those skilled in the art that other various modifications could be made to the device without the parting from the spirit in scope of this invention. All such modifications and changes fall within the scope of the claims and are intended to be covered thereby.

What is claimed is:

1. A wall forming system comprising;

a pair of panels positioned in parallel spaced alignment;

each panel having an outer section having a top edge and a bottom edge and an inner section having a top edge and a bottom edge, wherein each inner section is positioned inwardly of each outer section toward the opposing panel;

a cavity defined between the pair of opposing panels wherein the cavity has a web section defined between the opposing inner sections and a pair of column sections defined between the opposing outer sections;

at least one furring strip assembly secured to the pair of panels to hold the panels in spaced relation said furring strip assembly having retaining flanges and a web that spans the distance between the flanges;

a retainer disposed within the furring strip assembly and within the cavity;

said retainer positioned in contact with the panels to hold the panels in place; and wherein the top edge and bottom edge of the inner panel are taper toward one another so as to promote the flow of hardening material within the cavity.

2. A wall forming system, comprising:

a pair of panels in spaced relation at least one furring strip assembly secured to the pair of panels to hold the panels in spaced relation, a retainer disposed within the furring strip assembly and in contact with the panels to hold the panels in place; and a corner section attached to an end of the pair of panels and including an inner corner panel and an outer corner panel wherein a support member surrounds an outer surface of the outer corner panel.

3. A wall forming system comprising:

a pair of panels;

each panel having an outer section having a top edge and a bottom edge and an inner section having a top edge and a bottom edge, wherein each inner section is positioned inwardly of each outer section toward the opposing panel;

a cavity defined between the pair of opposing panels wherein the cavity has a web section defined between the opposing inner sections and a pair of column sections defined between the opposing outer sections;

at least one furring strip assembly secured to the pair of panels to hold the panels in spaced relation;

said furring strip assembly having retaining flanges and a web that spans the distance between the flanges;

a retainer disposed within the furring strip assembly and within the cavity; and said retainer positioned in contact with the panels to hold the panels in place.

4. The wall forming system of claim 3 wherein the retainer is within the column section of the cavity.

5. The wall forming system of claim 3 wherein the retainer has a longitudinal section with supporting flanges.

6. The wall forming system of claim 5 wherein the flanges have arcuate ends that engage the panels.

7. The wall forming system of claim 3 wherein the furring strip assembly has a plurality of retaining slots that receive the retainer.

8. The wall forming system of claim 3 further comprising a pin that locks the retainer to the furring strip assembly.

9. The wall forming system of claim 1 further comprising a spring clip that locks the retainer to the furring strip assembly.

10. The wall forming system of claim 3 wherein the retainer has at least one vertical rebar holder.

11. The wall forming system of claim 6 wherein the ends of the flanges of the retainer are inserted through slots disposed through the web of the furring strip assembly.

12. A wall forming system comprising:

a pair of panels in spaced parallel relation;

at least one furring strip assembly secured to the pair of panels to hold the panels in spaced relation, a retainer disposed within the furring strip assembly and in contact with the furring strip assembly and in contact with the panels to hold the panels in place;

wherein the retainer has more than one vertical rebar holder.

13. The system of claim 12 wherein the retainer has a locking device.

* * * * *